US008963965B2

(12) United States Patent
Jun et al.

(10) Patent No.: US 8,963,965 B2
(45) Date of Patent: Feb. 24, 2015

(54) METHOD FOR GENERATING DATA FOR DRIVING A DISPLAY PANEL, DATA DRIVING CIRCUIT FOR PERFORMING THE SAME AND DISPLAY DEVICE HAVING THE DATA DRIVING CIRCUIT

(75) Inventors: Bong-Ju Jun, Cheonan-si (KR); Bong-Im Park, Cheonan-si (KR); Hoi-Sik Moon, Cheonan-si (KR); Jae-Won Jeong, Seoul (KR); Yong-Jun Choi, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 975 days.

(21) Appl. No.: 12/356,902

(22) Filed: Jan. 21, 2009

(65) Prior Publication Data

US 2009/0256865 A1 Oct. 15, 2009

(30) Foreign Application Priority Data

Apr. 10, 2008 (KR) ..... 2008-32922

(51) Int. Cl.

*G09G 5/10* (2006.01)
*G09G 3/36* (2006.01)
*G09G 3/20* (2006.01)

(52) U.S. Cl.

CPC ..... *G09G 3/3688* (2013.01); *G09G 3/2044* (2013.01); *G09G 2300/0447* (2013.01); *G09G 2310/027* (2013.01); *G09G 2310/0297* (2013.01); *G09G 2310/08* (2013.01); *G09G 2320/0242* (2013.01); *G09G 2320/0276* (2013.01); *G09G 2320/028* (2013.01)

USPC ..... 345/690; 345/204; 345/55

(58) Field of Classification Search

USPC ..... 345/690, 204, 55

See application file for complete search history.

(56) References Cited

U.S. PATENT DOCUMENTS

| | | | | |
|---|---|---|---|---|
| 2006/0103682 | A1* | 5/2006 | Kunimori et al. | 345/690 |
| 2006/0198009 | A1* | 9/2006 | Morita | 359/245 |
| 2007/0273677 | A1* | 11/2007 | Kim | 345/204 |
| 2011/0007090 | A1* | 1/2011 | Chung et al. | 345/596 |

FOREIGN PATENT DOCUMENTS

| | | | |
|---|---|---|---|
| JP | 2006243232 | A | 9/2006 |
| KR | 1020060132942 | A | 12/2006 |
| KR | 1020070044713 | A | 4/2007 |
| KR | 1020070102880 | A | 10/2007 |

* cited by examiner

*Primary Examiner* — William Boddie
*Assistant Examiner* — Leonid Shapiro
(74) *Attorney, Agent, or Firm* — Cantor Colburn LLP

(57) ABSTRACT

A method for generating data for driving a display panel is provided in which first compensation data of (N+k) bits, corresponding to grayscale data of N bits, is generated, wherein values of N and k are natural numbers. A first gamma curve is applied to the first compensation data of (N+k) bits. Second compensation data of (N+k) bits, corresponding to the grayscale data of N bits, is generated. A second gamma curve is applied to the second compensation data of (N+k) bits. The first compensation data or the second compensation data are selectively output and converted into analog data signals. The analog data signals are output to a data line. Accordingly, the first compensation data and second compensation data includes a multidomain structure which improves display quality. A data driving circuit and a display device including the data driving circuit for performing the method are also provided.

12 Claims, 6 Drawing Sheets

METHOD FOR GENERATING DATA FOR DRIVING A DISPLAY PANEL, DATA DRIVING CIRCUIT FOR PERFORMING THE SAME AND DISPLAY DEVICE HAVING THE DATA DRIVING CIRCUIT

This application claims priority to Korean Patent Application No. 2008-32922, filed on Apr. 10, 2008, and all the benefits accruing therefrom under 35 U.S.C. §119, the contents of which in its entirety are herein incorporated by reference.

BACKGROUND OF THE INVENTION

1. Field of the Invention

The present invention relates to a method for generating data for driving a display panel, a data driving circuit for performing the method, and a display device having the data driving circuit. More particularly, the present invention relates to a method for generating data for driving a display panel in a display device displaying an image, a data driving circuit for performing the method, and a display device having the data driving circuit.

2. Description of the Related Art

Generally, a liquid crystal display ("LCD") device displays an image by applying a voltage to a liquid crystal layer disposed between two substrates. The voltage to the liquid crystal layer controls optical transmissivity.

To display an image on the LCD, the liquid crystal layer transmits light. Conventionally, the light passes in a direction which is not shielded by liquid crystal molecules of the liquid crystal layer. As a result, the LCD device provides a relatively narrow viewing angle of the image. In order to solve the narrow viewing angle, a vertical alignment ("VA") mode of the LCD device has been previously developed to obtain a wide viewing angle.

The LCD device in the VA mode includes a liquid crystal layer having a negative-type dielectric constant anisotropy sealed between two substrates, which are aligned perpendicular to each other. Liquid crystal molecules of the liquid crystal layer have homeotropic alignment properties. When a voltage is not applied between the two substrates, the liquid crystal molecules of the liquid crystal layer are arranged substantially vertical to a surface of a substrate to display black. However, when a predetermined voltage is applied between the two substrates, the liquid crystal molecules of the liquid crystal layer are arranged substantially parallel with the surface of the substrate to display white. Thus, when a voltage smaller than the predetermined voltage is applied between the two substrates, the liquid crystal molecules of the liquid crystal layer are arranged tilted to the surface of the substrate to display gray.

The LCD device in the VA mode has a narrow viewing angle. Thus, in order to solve the narrow viewing angle in the VA mode, a patterned vertical alignment ("PVA") mode is used. The LCD device in the PVA mode includes a color filter substrate having a patterned common electrode and an array substrate having patterned sub-pixel electrodes to employ a multidomain structure. In addition, a super-PVA ("S-PVA) mode has been developed from the PVA mode. In the S-PVA mode, different pixel voltages are applied to the sub-pixel electrodes.

An accurate color capture ("ACC") technique is used in the LCD device to improve display quality by using a stored lookup table. In the lookup table, compensation data, which is mapped one-to-one with grayscale data, is stored.

When the ACC technique is applied to the LCD device in the S-PVA mode, the LCD device generates a yellowish phenomenon displayed in a side viewing angle.

Thus, it is desired to develop a method for driving a display panel in a LCD device to improve display quality.

BRIEF SUMMARY OF THE INVENTION

An exemplary embodiment of the present invention provides a method for generating data for driving a display panel to improve display quality.

Another exemplary embodiment of the present invention also provides a data driving circuit for performing the method thereof.

Still another exemplary embodiment of the present invention also provides a display device having the data driving circuit for performing the method thereof.

According to an exemplary embodiment of the present invention, there is provided a method for generating data for driving a display panel. In the method, first compensation data of (N+k) bits corresponding to grayscale data of N bits received in a driver chip are generated, wherein values of N and k are natural numbers. A first gamma curve is applied to the first compensation data of (N+k) bits. Second compensation data of (N+k) bits corresponding to the grayscale data of N bits are generated. A second gamma curve is applied to the second compensation data of (N+k) bits. The first compensation data and the second compensation data are selectively output. The selected first compensation data and the second compensation data are converted into analog data signals. The analog data signals are output.

According to another exemplary embodiment of the present invention, a data driving circuit includes a first compensating section, a second compensating section and a digital-to-analog converter ("DAC"). The first compensating section receives a first gamma curve and generates first compensation data of (N+k) bits corresponding to received grayscale data of N bits, wherein values of N and k are natural numbers. The second compensating section receives a second gamma curve different from the first gamma curve and generates second compensation data of (N+k) bits corresponding to the grayscale data of N bits. The DAC outputs the first compensation data and second compensation data as an analog data signals.

According to still another exemplary embodiment of the present invention, a display device includes a display panel, a timing control section, a data driving circuit and a gate driving circuit. The display panel includes a plurality of unit pixels, each of the unit pixels including a first sub-pixel electrically connected to a data line and a first gate line, and a second sub-pixel electrically connected to the data line and a second gate line adjacent to the first gate line. The timing control section receives grayscale data corresponding to the unit pixels. The data driving circuit includes a first compensating section using the grayscale data to generate first compensation data corresponding to the first sub-pixel, a second compensating section using the grayscale data to generate second compensation data corresponding to the second sub-pixel, and a DAC converter to convert the first compensation data and second compensation data into analog data signals to output to the data line. The gate driving circuit outputs gate signals to the first gate line and second gate line.

According to yet another exemplary embodiment of the present invention, there is provided a method for generating data for driving a display panel, the data driving circuit for performing the method and the display device having the data driving circuit of the present invention, compensation data of different colors are applied to the sub-pixels for a multidomain structure to improve display quality.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
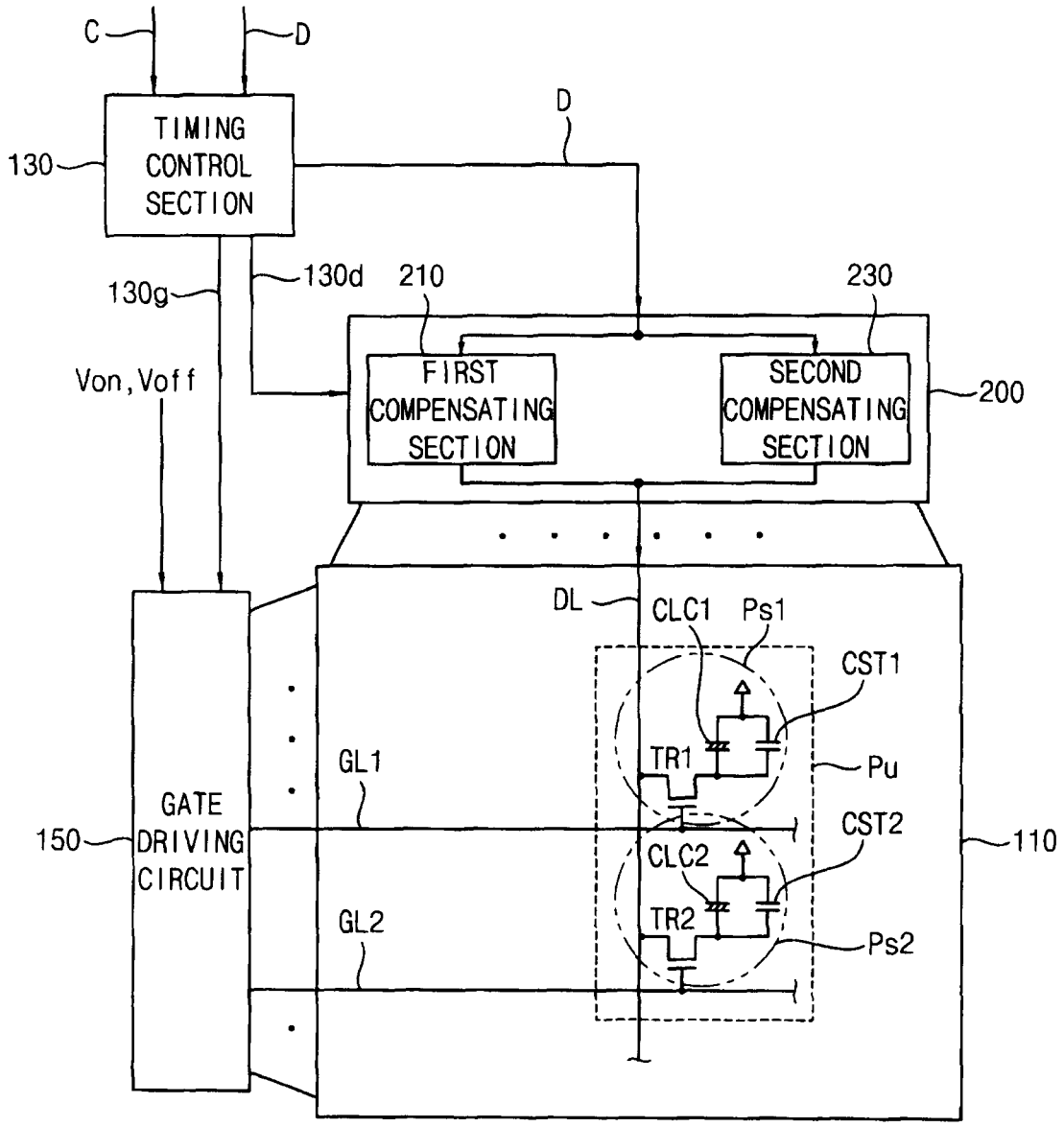
FIG. 1 is a block diagram illustrating a display device according to an exemplary embodiment of the present invention.

The invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be explained in further detail with reference to the accompanying drawings.

FIG. 1 is a block diagram illustrating a display device according to an exemplary embodiment of the present invention.

Referring to FIG. 1, a display device includes a display panel 110, a timing control section 130, a gate driving circuit 150 and a data driving circuit 200.

The display panel 110 has a super patterned vertical alignment ("S-PVA") mode, and includes a plurality of unit pixels Pu. Each unit pixel Pu includes a first sub-pixel Ps1 and a second sub-pixel Ps2.

The first sub-pixel Ps1 includes a first transistor TR1 connected to a first gate line GL1 and a data line DL, a first liquid crystal capacitor CLC1 electrically connected to the first transistor TR1 and a first storage capacitor CST1. The second sub-pixel Ps2 includes a second transistor TR2 connected to a second gate line GL2 and the data line DL, a second liquid crystal capacitor CLC2 electrically connected to the second transistor TR2 and a second storage capacitor CST2.

Still referring to FIG. 1, the timing control section 130 externally receives a control signal C and data D. The timing control section 130 generates timing control signals which control driving time of the gate driving circuit 150 and the data driving circuit 200 by using the received control signal C. Hereinafter, the timing control signals are referred to as a gate control signal 130*g* and a data control signal 130*d*. The timing control section 130 outputs the gate control signal 130*g* and the data control signal 130*d* to the gate driving circuit 150 and data driving circuit 200, respectively. The timing control section 130 transfers the externally received data D to the data driving circuit 200.

The gate driving circuit 150 generates a gate signal by using the gate control signal 130*g* provided from the timing control section 130 and a gate on voltage Von and off voltage Voff externally received (not shown). For example, the gate driving circuit 150 outputs a gate signal having a pulse width of H/2 (wherein H is a horizontal period) to the first gate line GL1 electrically connected to the first transistor TR1, and outputs a gate signal having a pulse width of H/2 to the second gate line GL2 electrically connected to the second transistor TR2.

Figure 2:
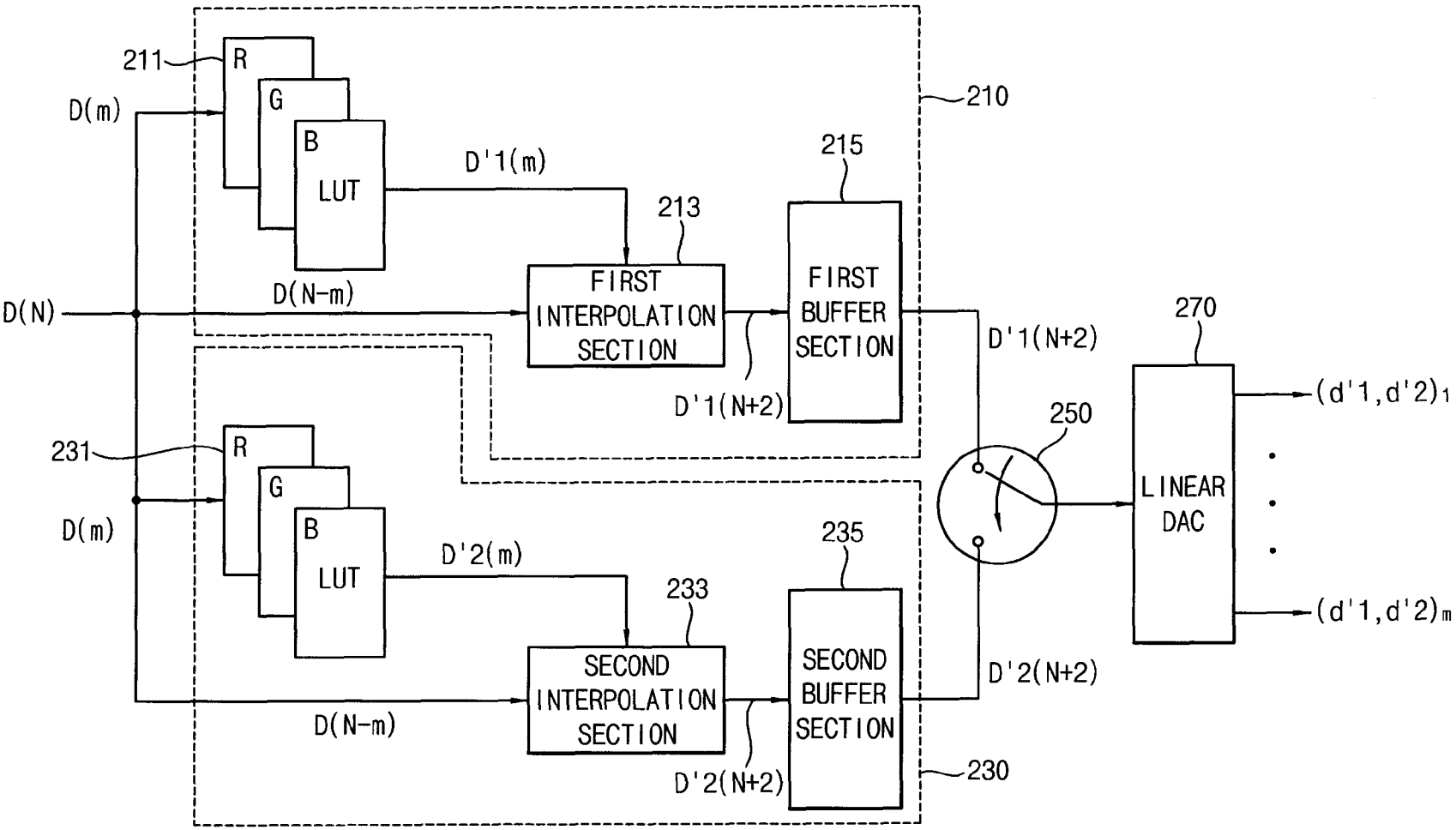
FIG. 2 is a block diagram illustrating an exemplary embodiment of a data driving circuit of the display device in FIG. 1.

The data driving circuit 200 includes a first compensating section 210 and a second compensating section 230. The first compensating section 210 generates first compensation data D'1 (as shown in FIG. 2), which reflects a first gamma curve, by using the data D provided from the timing control section 130. The second compensating section 230 generates second compensation data D'2 (as shown in FIG. 2), which reflects a second gamma curve different from the first gamma curve, by using the data D.

For example, the data driving circuit 200 receives the data D corresponding to at least one of the unit pixels Pu. The first compensating section 210 generates the first compensation data D'1 applied to the first sub-pixel Ps1 corresponding to the data D. The second compensating section 230 generates the second compensation data D'2 applied to the second sub-pixel Ps2 corresponding to the data D.

In addition, the data driving circuit 200 converts the first compensation data D'1 and second compensation data D'2 into analog signals, and outputs the converted analog signals to the data line DL, which is electrically connected to the first transistor TR1 and second transistor TR2. For example, the data driving circuit 200 converts the first compensation data D'1 into a first analog data signal and outputs the first analog data signal to the data line DL during an early half-period. The data driving circuit 200 also converts the second compensation data D'2 into a second analog data signal and outputs the second analog data signal to the data line DL during a later half-period.

Thus, the first sub-pixel Ps1 is driven based on the first compensation data D'1 during the early half-period, and the second sub-pixel Ps2 is driven based on the second compensation data D'2 during the later half-period. As a result, the unit pixel Pu is driven in a multidomain mode.

Since the first sub-pixel Ps1 and second sub-pixel Ps2 are respectively driven by the first compensation data D'1 and second compensation data D'2, which correspond to different color compensation data, color coordinates according to gray levels in a front viewing angle and a side viewing angle are substantially the same. Thus, a yellowish phenomenon in a side viewing angle may be prevented.

Figure 3:
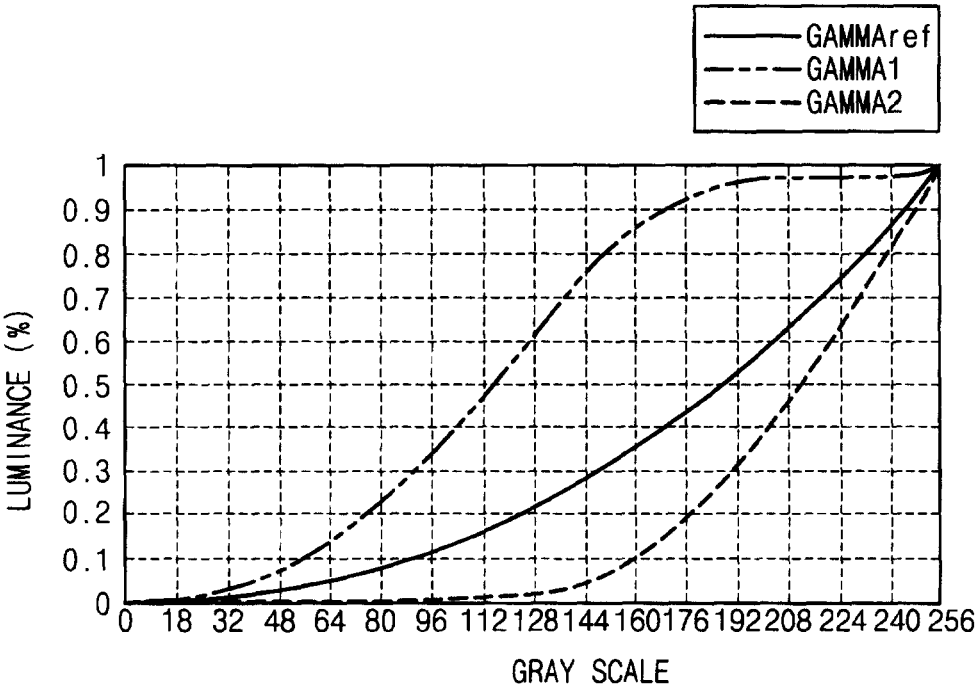
FIG. 3 is a graph showing gamma curves applied to a first compensating section and second compensating section of the display device in FIG. 1.

FIG. 2 is a block diagram illustrating an exemplary embodiment of a data driving circuit of the display device in FIG. 1. FIG. 3 is a graph showing gamma curves applied to a first compensating section and second compensating section of the display device in FIG. 1.

Referring to FIGS. 1 to 3, the data driving circuit 200 includes a first compensating section 210, a second compensating section 230, a switching section 250 and a linear digital-to-analog converter ("linear DAC") 270. The data driving circuit 200 may be in a chip form, but is not limited thereto.

Referring to FIG. 2, the first compensating section 210 includes a first storage section 211, a first interpolation section 213 and a first buffer section 215.

The first compensation data D'1 provided to the first sub-pixel Ps1 of the unit pixel Pu is stored in the first storage section 211. The first compensation data D'1 of red (R), green (G) and blue (B), which corresponds to grayscale data D of red (R), green (G) and blue (B) entering the first storage section 211, is stored in a lookup table LUT.

For example, first sample grayscale data D(m) of m bits are sampled from grayscale data D(N) of a total of N bits to reduce memory capacity. The value of N is a natural number, and the value of m is a natural number and smaller than or equal to N. The first sample compensation data D'1(*m*) of m bits with respect to the first sample grayscale data D(m) is stored in the first storage section 211. Thus, when the first sample grayscale data D(m) of m bits is input to the first storage section 211, the first storage section 211 outputs first sample compensation data D'1(*m*) of m bits corresponding to the first sample grayscale data D(m).

The first interpolation section 213 generates first compensation data D'1(N+2) of (N+k) bits from the first sample compensation data D'1(*m*) of m bits, which are output from the first storage section 211 by using an interpolation method. The first interpolation section 213 then outputs the first compensation data D'1(N+2) of (N+k) bits. The first interpolation section 213 generates first compensation data D'1(N+2) of (N+k) bits corresponding to remaining grayscale data D(N−m), which are not sampled by using the first sample compensation data D'1(*m*) provided from the first storage section 211. The first interpolation section 213 then outputs the first compensation data D'1(N+2) of (N+k) bits.

A first gamma curve GAMMAS in FIG. 3 corresponds to the grayscale data D of N bits, which is input to the first compensating section 210. The first gamma curve GAMMA1 is applied to the first compensating section 210 and the first compensating section 210 generates the first compensation data D'1 of (N+k) bits, which is extended for color compensation by k bits (wherein the value of k is a natural number). Hereinafter, exemplary embodiments of the present invention will be described in which the value of k is, for example, 2.

The first buffer section 215 stores the first compensation data D'1(N+2) of (N+2) bits generated from the first interpolation section 213.

Graphs shown in FIG. 3 have an x-axis corresponding to grayscale data (for example, 256 grayscale) and a y-axis corresponding to a percentage of luminance (or transmissivity). Referring to FIG. 3, a reference gamma curve GAMMAref corresponds to a gamma curve in which front visibility is optimized, and a first gamma curve GAMMA1 and a second gamma curve GAMMA2 are gamma curves in which side visibility is optimized. The first gamma curve GAMMA1 is applied to the first sub-pixel Ps1, and the second gamma curve GAMMA2 is applied to the second sub-pixel Ps2.

The second compensating section 230 includes a second storage section 231, a second interpolation section 233 and a second buffer section 235, as shown in FIG. 2.

The second compensation data D'2 provided to the second sub-pixel Ps2 of the unit pixel Pu is stored in the second storage section 231. The second compensation data D'2 of red (R), green (G) and blue (B), which corresponds to grayscale data D of red (R), green (G) and blue (B), respectively, entering the second storage section 231, is stored in a lookup table LUT.

For example, second sample grayscale data D(m) of m bits are sampled from grayscale data D(N) of a total of N bits to reduce memory capacity. The value of N is a natural number, and the value of m is a natural number and smaller than or equal to N. The second sample compensation data D'2(*m*) of m bits with respect to the second sample grayscale data D(m) is stored in the second storage section 231. Thus, when the second sample grayscale data D(m) of m bits is input to the second storage section 231, the second storage section 231 outputs second sample compensation data D'2(*m*) of m bits corresponding to the second sample grayscale data D(m).

The second interpolation section 233 generates second compensation data D'2(N+2) of (N+2) bits from the second sample compensation data D'2(*m*) of m bits, which are output from the second storage section 231 by using an interpolation method. The second interpolation section 233 then outputs the second compensation data D'2(N+2) of (N+2) bits. The second interpolation section 233 generates second compensation data D'2(N+2) of (N+2) bits corresponding to remaining grayscale data D(N−m), which are not sampled by using the second sample compensation data D'2(*m*) provided from the second storage section 231 and outputs the second compensation data D'2(N+2) of (N+2) bits.

The second gamma curve GAMMA2 in FIG. 3 corresponds to the grayscale data D of N bits, which is input to the second compensating section 230. The second gamma curve GAMMA2 is applied to the second compensating section 230. The second compensating section 230 generates the second compensation data D'2 of (N+2) bits, which is extended for color compensation by 2 bits.

The second buffer section 235 stores the second compensation data D'2(N+2) of (N+2) bits generated from the second interpolation section 233.

The switching section 250 selectively outputs the first compensation data D'1 and the second compensation data D'2 to the linear DAC 270 in accordance with the control of the timing control section 130 (as shown in FIG. 1). For example, the switching section 250 selects and outputs the first compensation data D'1 during the early half-period, and selects and outputs the second compensation data D'2 during the later half-period.

The linear DAC 270 converts the first compensation data D'1 of (N+2) bits and the second compensation data D'2 of (N+2) bits, which is input to the linear DAC 270, into first analog data signal d'1 and second analog data signal d'2, and outputs the converted analog data signal d'1 and analog signal d'2. The linear DAC 270 may employ, for example, a cyclic DAC (C-DAC). The C-DAC has a switching operation which includes two capacitors (not shown). The two capacitors correspond to input digital data to repeatedly sample and hold voltages to output the voltages. The linear DAC 270 outputs a linear first analog data signal d'1 and second analog data signal d'2 corresponding to the first compensation data D'1 of (N+2) bits and second compensation data D'2 of (N+2) bits, respectively, which are input to the linear DAC 270.

Figure 4:
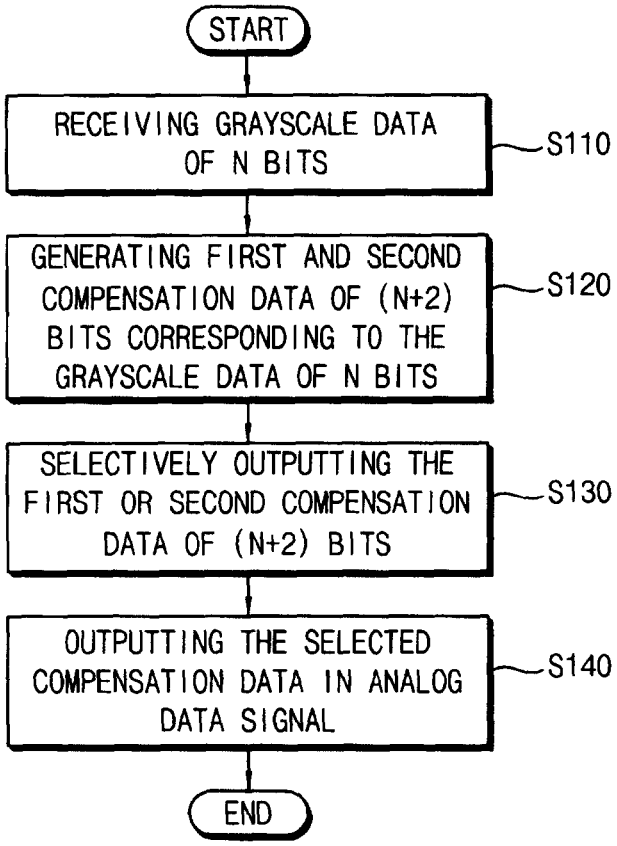
FIG. 4 is a flowchart illustrating a method of driving the data driving circuit illustrated in FIG. 2.

FIG. 4 is a flowchart illustrating a method of driving the data driving circuit in FIG. 2.

Referring to FIGS. 1, 2 and 4, the data driving circuit 200 receives grayscale data D of N bits provided from the timing control section 130 (as shown in FIG. 1) (step S110).

Referring to FIGS. 2 and 4, the first compensating section 210 of the data driving circuit 200 generates the first compensation data D'1 of (N+2) bits, which is extended by 2 bits by using the grayscale data D of N bits. The second compensating section 230 of the data driving circuit 200 outputs the second compensation data D'2 of (N+2) bits, which is extended by 2 bits by using the grayscale data D of N bits (step S120).

For example, in step S120, the received grayscale data D of N bits yield the first compensation data D'1(N+2) of (N+2) bits by using the first sample grayscale data of upper m bits stored in the first storage section 211 and the first interpolation section 213. The first compensation data D'1(N+2) of (N+2) bits is stored in the first buffer section 215.

Further, the second compensation data D'2 are also generated and stored in the second buffer section 235.

Then, the switching section 250 selectively outputs the first compensation data D'1 (N+2) of (N+2) bits and second compensation data D'2(N+2) of (N+2) bits, which are output from the first compensating section 210 and second compensating section 230, respectively, in accordance with the control of the timing control section 130 (as shown in FIG. 1) (step S130).

The linear DAC 270 outputs the received first compensation data D'1 (N+2) or second compensation data D'2(N+2) in the first analog data signal d'1 or the second analog data signal d'2 (step S140).

Figure 5:
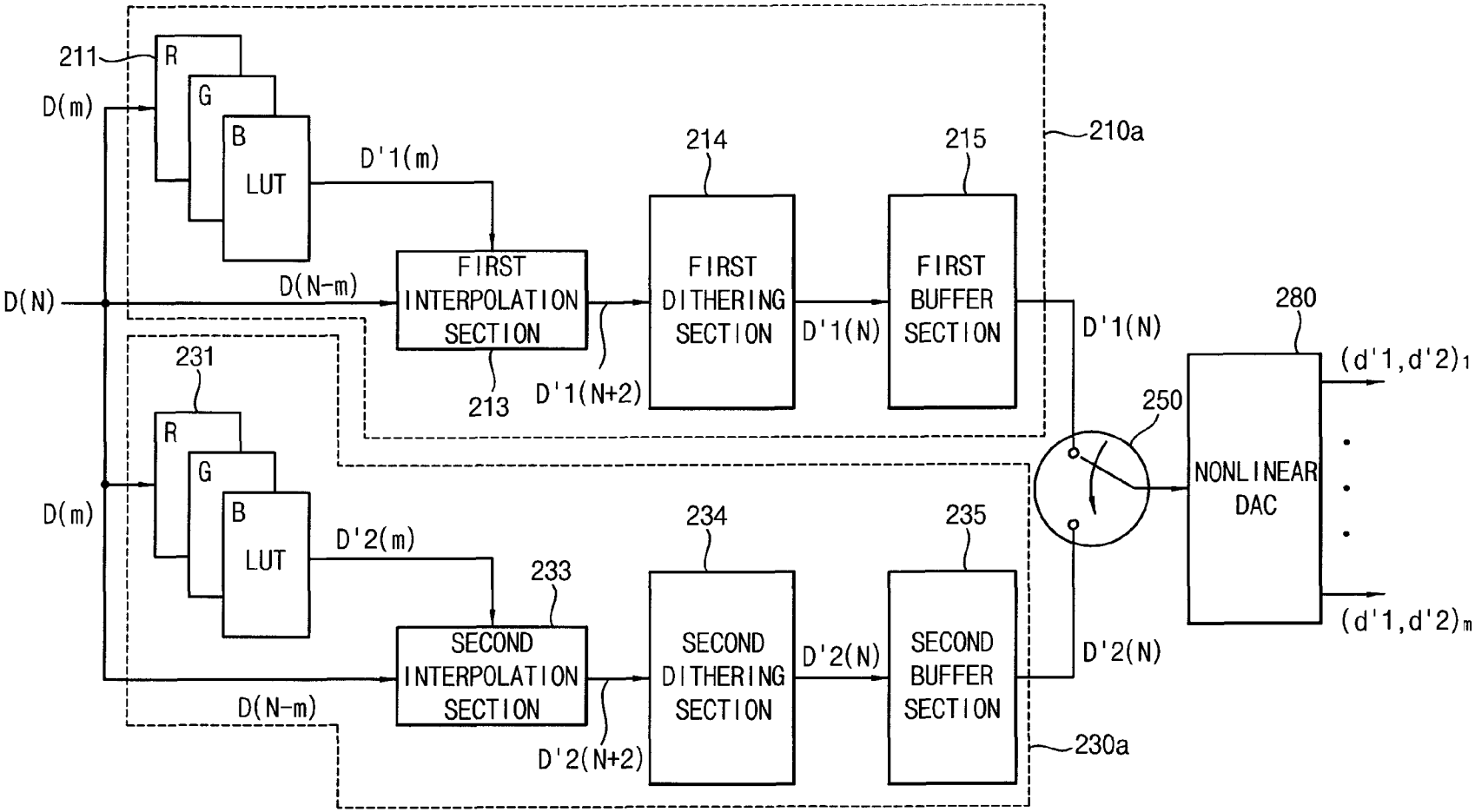
FIG. 5 is a block diagram illustrating another exemplary embodiment of a data driving circuit of the display device in FIG. 1.

FIG. 5 is a block diagram illustrating another exemplary embodiment of a data driving circuit of the display device in FIG. 1.

Referring to FIGS. 1 and 5, the data driving circuit 200 includes a first compensating section 210*a*, a second compensating section 230*a*, a switching section 250 and a nonlinear digital-to-analog converter (nonlinear "DAC") 280. The data driving circuit 200 may be in one-chip form, but is not limited thereto.

The first compensating section 210*a* includes a first storage section 211, a first interpolation section 213, a first dithering section 214 and a first buffer section 215.

The first compensation data D'1 provided to the first subpixel Ps1 of the unit pixel Pu is stored in the first storage section 211. The first compensation data D'1 of red (R), green (G) and blue (B), which corresponds to grayscale data D of red (R), green (G) and blue (B) entering the first storage section 211, is stored in a lookup table LUT.

For example, first sample grayscale data D(m) of m bits) are sampled from grayscale data D(N) of a total of N bits to reduce memory capacity. The value of N is a natural number, and the value of m is a natural number and smaller than or equal to N. The first sample compensation data D'1 (*m*) of m bits with respect to the first sample grayscale data D(m) is stored in the first storage section 211. Thus, when the first sample grayscale data D(m) of m bits is input to the first storage section 211, the first storage section 211 outputs first sample compensation data D'1(*m*) of m bits corresponding to the first sample grayscale data D(m).

The first interpolation section 213 generates first compensation data D'1(N+2) of (N+k) bits from the first sample compensation data D'1(*m*) of m bits which are output from the first storage section 211 by using an interpolation method. The first interpolation section 213 then outputs the first compensation data D'1(N+2) of (N+k) bits. The first interpolation section 213 generates first compensation data D'1(N+2) of (N+k) bits corresponding to remaining grayscale data D(N−m) which are not sampled by using the first sample compensation data D'1(*m*) provided from the first storage section 211. The first interpolation section 213 then outputs the first compensation data D'1(N+2) of (N+k) bits.

The first dithering section 214 dithers the first compensation data D'1(N+2) of (N+2) bits output from the first interpolation section 213 to first compensation data D'1(N) of N bits.

The first buffer section 215 stores the dithered first compensation data D'1(N) of N bits.

The second compensating section 230*a* includes a second storage section 231, a second interpolation section 233, a second dithering section 234 and a second buffer section 235.

The second compensation data D'2 provided to the second sub-pixel Ps2 of the unit pixel Pu is stored in the second storage section 231. The second compensation data D'2 of red (R), green (G) and blue (B), corresponding to grayscale data D of red (R), green (G) and blue (B) entering the second storage section 231, is stored in a lookup table LUT.

For example, second sample grayscale data D(m) of m bits are sampled from grayscale data D(N) of a total of N bits to reduce memory capacity. The value of N is a natural number, and the value of m is a natural number smaller than or equal to N. The second sample compensation data D'2(*m*) of m bits with respect to the second sample grayscale data D(m) is stored in the second storage section 231. Thus, when the second sample grayscale data D(m) of m bits is input to the second storage section 231, the second storage section 231 outputs second sample compensation data D'2(*m*) of m bits corresponding to the second sample grayscale data D(m).

The second interpolation section 233 generates second compensation data D'2(N+2) of (N+2) bits from the second sample compensation data D'2(*m*) of m bits which are output from the second storage section 231 by using an interpolation method. The second interpolation section 233 then outputs the second compensation data D'2(N+2) of (N+2) bits. The second interpolation section 233 generates second compensation data D'2(N+2) of (N+2) bits corresponding to remaining grayscale data D(N−m), which are not sampled by using the second sample compensation data D'2(*m*) provided from the second storage section 231, and outputs the second compensation data D'2(N+2) of (N+2) bits.

The second dithering section 234 dithers the second compensation data D'2(N+2) of (N+2) bits output from the second interpolation section 233 to second compensation data D'2 (N) of N bits.

The second buffer section 235 stores the dithered second compensation data D'2(N) of N bits.

The switching section 250 selectively outputs the first compensation data D'1(N) and the second compensation data D'2(N) in accordance with the control of the timing control section 130 (as shown in FIG. 1).

The nonlinear DAC 280 converts the first compensation data D'1(N) of N bits and the second compensation data D'2(N) of N bits, which are input to the nonlinear DAC 280, into analog data signal d'1 and analog data signal d'2, and outputs the converted analog data signal d'1 and analog data signal d'2. The nonlinear DAC 280 may employ, for example, a resistance DAC (R-DAC). The R-DAC has a resistor string in which resistors are connected in series. The R-DAC outputs voltages corresponding to input digital data. The resistance string includes resistors having different resistances to output voltages having nonlinear levels.

The nonlinear DAC 280 outputs the nonlinear first analog data signal d'1 and second analog data signal d'2 corresponding to the first compensation data D'1 of N bits and second compensation data D'2 of N bits, which are input to the nonlinear DAC 280.

Figure 6A:
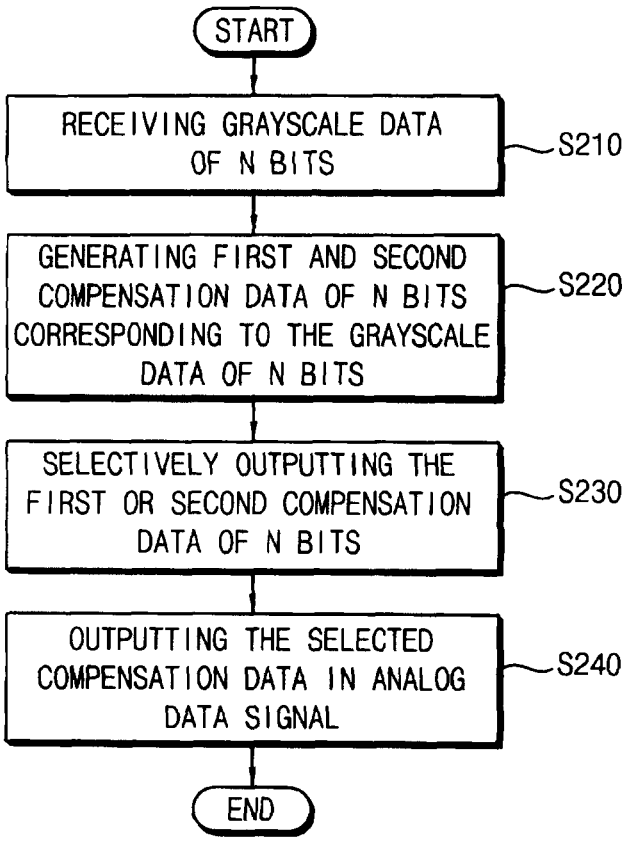
FIGS. 6A and 6B are flowcharts illustrating methods of driving the data driving circuit in FIG. 5.
Figure 6B:
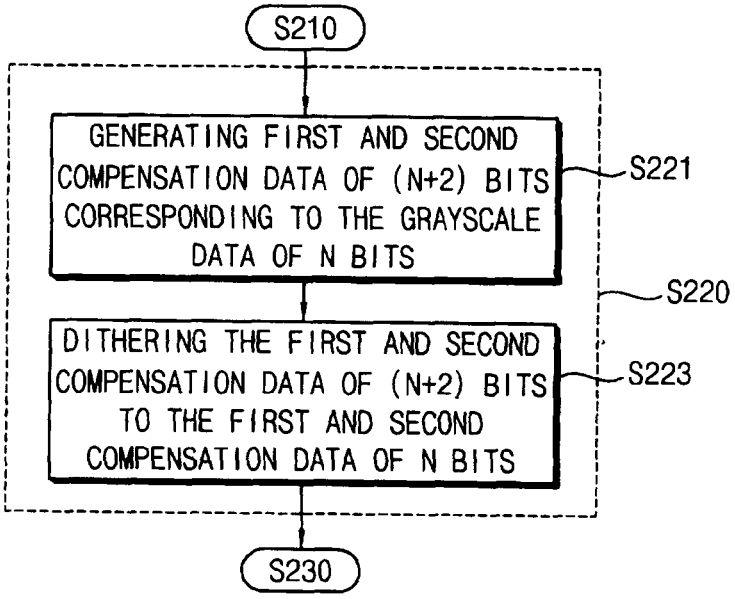

FIGS. 6A and 6B are flowcharts illustrating methods of driving the data driving circuit illustrated in FIG. 5.

Referring to FIGS. 1, 5, 6A and 6B, the data driving circuit 200 receives grayscale data D of N bits provided from the timing control section 130 (as shown in FIG. 1) (step S210).

Referring to FIGS. 5, 6A and 6B, the first compensating section 210*a* of the data driving circuit 200 outputs the first compensation data D'1(N) of N bits, which are compensated by using the grayscale data D(N) of N bits. The second compensating section 230*a* of the data driving circuit 200 outputs the second compensation data D'2(N) of N bits, which are compensated by using the grayscale data D(N) of N bits (step S220).

For example, in step S220, the received grayscale data D(N) of N bits yield the first compensation data D'1(N+2) of (N+2) bits by using the first sample grayscale data D(m) of upper m bits stored in the first storage section 211 and the first interpolation section 213. The first dithering section 214 dithers the first compensation data D'1(N+2) of (N+2) bits provided from the first interpolation section 213 to the first compensation data D'1(N) of N bits. The first dithering section 214 then outputs the dithered first compensation data D'1(N) of N bits to the first buffer section 215 (step S213).

Further, the second compensation data D'2(N) of N bits are also generated and stored in the second buffer section 235.

Then, the switching section 250 selectively outputs the first compensation data D'1(N) of N bits and the second compensation data D'2(N) of N bits, which are output from the first compensating section 210*a* and second compensating section 230*a*, respectively, in accordance with the control of the timing control section 130 (as shown in FIG. 1) (step S230).

The nonlinear DAC 280 outputs the received first compensation data D'1(N) or second compensation data D'2(N) in the first analog data signal d'1 or the second analog data signal d'2 (step S240).

According to the above, in a display device of an S-PVA mode in which a unit pixel is divided into two sub-pixels for a multidomain structure, different gamma curves are applied to the sub-pixels to improve a viewing angle, and compensation data having extended bits are applied to the sub-pixels. As a result, display defects, such as a yellowish phenomenon in a side viewing angle, are removed. In addition, sample grayscale data of m bits sampled from grayscale data of a total of N bits are used to reduce memory capacity.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood by those of ordinary skill in the art that various changes in form and details may be made therein without departing from the spirit and/or scope of the present invention as defined by the following claims.

What is claimed is:

1. A data driving circuit comprising:

a first compensating section which receives a first gamma curve and generates first compensation data of (N+k) bits corresponding to received current grayscale data of N bits, wherein values of N and k are natural numbers, the current grayscale data comprising current red grayscale data, current green grayscale data and current blue grayscale data;

a second compensating section which receives a second gamma curve different from the first gamma curve and generates second compensation data of (N+k) bits corresponding to the current grayscale data of N bits; and a digital-to-analog converter ("DAC") outputting the first compensation data and second compensation data as analog data signals, wherein the first compensating section comprises:

a first storage section which stores a first red lookup table comprising first red sample compensation data corresponding to first sample red grayscale data of m bits sampled from the current red grayscale data of N bits, wherein a value of m is a natural number and smaller than N, a first green lookup table comprising first sample green compensation data corresponding to first sample green grayscale data of m bits sampled from the current green grayscale data of N bits, and a first blue lookup table comprising first sample blue compensation data corresponding to first sample blue grayscale data of m bits sampled from the current blue grayscale data of N bits, wherein the second compensating section comprises:

a second storage section which stores a second red lookup table comprising second sample red compensation data corresponding to second sample red grayscale data of m bits sampled from the current red grayscale data of N bits, a second green lookup table comprising second sample green compensation data corresponding to second sample green grayscale data of m bits sampled from the current green grayscale data of N bits, and a second blue lookup table comprising second sample blue compensation data corresponding to second sample blue grayscale data of m bits sampled from the current blue grayscale data of N bits.

2. The data driving circuit of claim 1, wherein the first compensating section further comprises:

a first interpolation section which uses first sample compensation data and remaining grayscale data, which is not sampled from current grayscale data of N bits to generate first compensation data of (N+k) bits.

3. The data driving circuit of claim 2, wherein the second compensating section comprises:

a second interpolation section which uses second sample compensation data and remaining grayscale data, which is not sampled from current grayscale data of N bits to generate second compensation data of (N+k) bits.

4. The data driving circuit of claim 3, wherein the DAC corresponds to a linear DAC.

5. The data driving circuit of claim 3, wherein the first compensating section further comprises a first dithering section which dithers the first compensation data of (N+k) bits to first compensation data of N bits, and the second compensating section further comprises a second dithering section which dithers the second compensation data of (N+k) bits to second compensation data of N bits.

6. The data driving circuit of claim 5, wherein the DAC corresponds to a nonlinear DAC.

7. A display device comprising:

a display panel comprising a plurality of unit pixels, each of the unit pixels including a first sub-pixel electrically connected to a data line and a first gate line, and a second sub-pixel electrically connected to the data line and a second gate line adjacent to the first gate line;

a timing control section which receives current grayscale data of N bits corresponding to the unit pixels;

a gate driving circuit which outputs gate signals to the first gate line and second gate line; and a data driving circuit comprising a first compensating section which uses the current grayscale data to generate first compensation data corresponding to the first sub-pixel, the current grayscale data comprising current red grayscale data, current green grayscale data and current blue grayscale data;

a second compensating section which uses the current grayscale data to generate second compensation data corresponding to the second sub-pixel; and a digital-to-analog converter (DAC) which converts the first compensation data and second compensation data into analog data signals and outputs the analog data signals to the data line, wherein the first compensating section comprises:

a first storage section which stores a first red lookup table comprising first red sample compensation data corresponding to first sample red grayscale data of m bits sampled from the current red grayscale data of N bits, wherein a value of m is a natural number and smaller than N, a first green lookup table comprising first sample green compensation data corresponding to first sample green grayscale data of m bits sampled from the current green grayscale data of N bits, and a first blue lookup table comprising first sample blue compensation data corresponding to first sample blue grayscale data of m bits sampled from the current blue grayscale data of N bits, wherein the second compensating section comprises:

a second storage section which stores a second red lookup table comprising second sample red compensation data corresponding to second sample red grayscale data of m bits sampled from the current red grayscale data of N bits, a second green lookup table comprising second sample green compensation data corresponding to second sample green grayscale data of m bits sampled from the current green grayscale data of N bits, and a second blue lookup table comprising second sample blue compensation data corresponding to second sample blue grayscale data of m bits sampled from the current blue grayscale data of N bits.

8. The data driving circuit of claim 7, wherein the first compensating section further comprises:

a first interpolation section which uses first sample compensation data and remaining grayscale data, which is not sampled from current grayscale data of N bits to generate first compensation data of (N+k) bits.

9. The data driving circuit of claim 8, wherein the second compensating section comprises:

a second interpolation section which uses second sample compensation data and remaining grayscale data, which is not sampled from current grayscale data of N bits to generate second compensation data of (N+k) bits.

10. The data driving circuit of claim 9, wherein the DAC corresponds to a linear DAC.

11. The data driving circuit of claim 9, wherein the first compensating section further comprises a first dithering section which dithers the first compensation data of (N+k) bits to first compensation data of N bits, and the second compensating section further comprises a second dithering section which dithers the second compensation data of (N+k) bits to second compensation data of N bits.

12. The data driving circuit of claim 11, wherein the DAC corresponds to a nonlinear DAC.

* * * * *